US005619075A

United States Patent [19]

Spoto et al.

[11] Patent Number: 5,619,075

[45] Date of Patent: Apr. 8, 1997

[54] TWO-STEP POWER DOOR LOCKING SYSTEM AND METHOD OF OPERATION

[75] Inventors: Thomas A. Spoto, Birmingham; Sean M. Newell, Allen Park, both of Mich.

[73] Assignee: Ford Motor Company, Dearborn, Mich.

[21] Appl. No.: 518,214

[22] Filed: Aug. 23, 1995

[51] Int. Cl.[6] ..... E05B 65/36

[52] U.S. Cl. ..... 307/10.2; 70/264; 180/287

[58] Field of Search ..... 307/9.1, 10.1, 307/10.2; 180/287, 289; 70/264, 237, 271, 277, DIG. 30; 340/825.31, 825.32

[56] References Cited

U.S. PATENT DOCUMENTS

| | | | |
|---|---|---|---|
| 4,887,064 | 12/1989 | Drori et al. | 340/825.31 |
| 5,030,949 | 7/1991 | Reis et al. | 70/264 |
| 5,157,375 | 10/1992 | Drori . | |
| 5,168,733 | 12/1992 | Rathmann et al. | 70/264 |
| 5,175,440 | 12/1992 | Robitschko et al. | 70/264 |
| 5,309,743 | 5/1994 | Kokubu et al. | 70/264 |

*Primary Examiner*—Richard T. Elms
*Attorney, Agent, or Firm*—Mark S. Sparschu

[57] ABSTRACT

An automotive locking system for an automotive vehicle has a latch with a locked and unlocked position, a switch having a first state and a second state and a timer. A controller is connected to the switch, the latch and the timer. The controller positions the latch of a door in the unlocked position if the duration the switch is in the first and second states corresponds to a valid switch signal rather than electrical noise or a shorted switch. The system may also control unlatching all the doors if the switch changes between the first and second states for predetermined durations of each state.

20 Claims, 4 Drawing Sheets

TWO-STEP POWER DOOR LOCKING SYSTEM AND METHOD OF OPERATION

BACKGROUND OF THE INVENTION

The present invention relates to a power door locking system for an automotive vehicle. More specifically, the invention relates to an operating method and apparatus for operating the power door locking system to prevent false lock actuations.

Key operated power locking systems are known in which a key is inserted into a lock cylinder in the door and rotated. Early systems used a stricly mechanical system to unlock the dook through a link to the latch mechanism. In more recent cases an electrical system supplements or replaces the mechanical system. Using an electrical system, either the driver's side door or all the vehicle doors unlock by special action of the key. In some systems the key is rotated in one direction for one door to unlock and rotated in the opposite direction for all doors to unlock. In another system, the key is turned the same way in quick succession to unlock all the doors.

Typically, power lock systems use a simple sensor switch connected to the lock cylinder to complete a circuit. The appropriate locks of the vehicle unlatch according to the switch signal detected.

Such systems are, however, susceptible to false signals from the switch under certain conditions. Typically, locking systems use edge detection to sense the transition between two states. One cause of false sensing is caused from spurious electrical noise in the electrical system of the vehicle or induced voltages from external sources such as lightning that may be mistaken by the system to be a true signal, resulting in erroneous operation of the locking system. Another cause of false sensing is that moisture enters the lock and shorts the switch terminals within the locks together that also may result in erroneous operation of the locking system.

It would therefore be desirable to have a locking system capable of preventing false actuations due to erroneous signals.

SUMMARY OF THE INVENTION

One advantage of the present invention is that the system is not only capable of preventing false lock actuations but it can also provide operator feedback to indicate if a sensor switch is faulty.

The present invention has a latch with a locked and unlocked position, a switch generating a signal having a first state and a second state and a timer. A controller is connected to the switch, the latch and the timer. The controller positions the latch in the unlocked position if the switch signal changes from the first state to the second state for at least a first predetermined time and less than a second predetermined time and if the switch signal then changes from said second state to said first state for at least a third predetermined amount of time.

DETAILED DESCRIPTION OF THE PREFERRED EMBODIMENT

Figure 1:
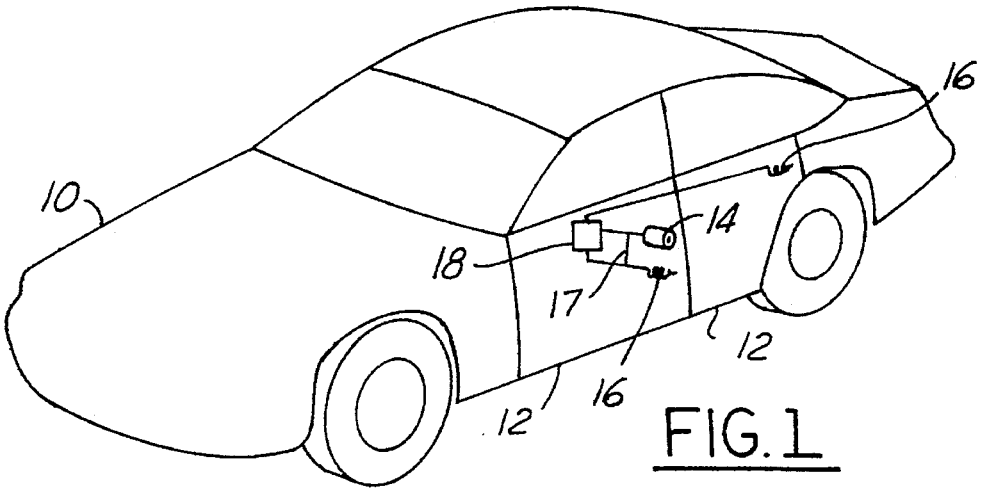
FIG. 1 is an automobile having a lock system according to the present invention.

Referring now to FIG. 1, a lock system is shown in an automobile having doors 12, a lock 14, a latch 16, a mechanical link 17, a control module 18 and solenoids 24. Front doors of automobile 10 have a lock 14 that is used to send an electrical signal to control module 18 to cause the locking and unlocking of latch 16. Mechanical link may also be employed to cause lacth 16 to unlatch upon a rotation of lock 14. Door 12 may also include a hatchback, a liftgate, or other lockable panel. In this example, when a lock 14 of a particular door is rotated once, the door associated with the lock unlocks either mechanically through link 17 or electrically through solenoid 24. When the key is rotated twice in succession, all the doors unlock electrically through activation of solenoid 24 by control module 18.

Figure 2:
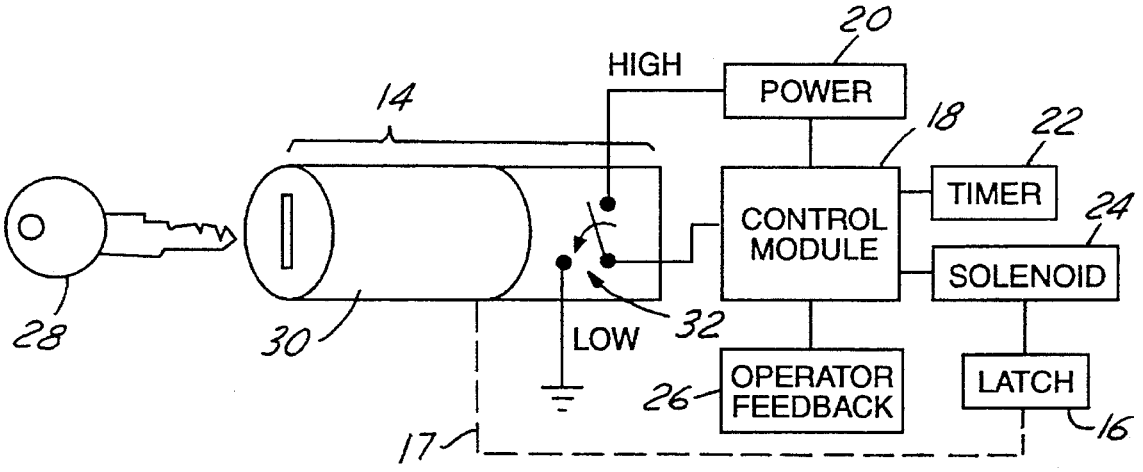
FIG. 2 is a block diagram of the preferred embodiment of the apparatus according to the present invention.

Referring now to FIG. 2, control module 18 is the central controller of the lock system. Control module 18 receives an input signal from lock 14 and a timer 22. Control module 18 supplies an output signal to control a solenoid 24, which in turn controls the mechanical movement of latch 16. Control module 18 also may supply an output signal to control an operator feedback device 26.

In the preferred embodiment, Lock 14 consists of a key 28, a lock cylinder 30, and a sensor switch 32. If key 28 is cut to match lock cylinder 30, rotating key 28 to a predetermined point within lock cylinder 30 changes the state of the signal from switch 32. Lock 14 may comprise a transponder, card access or other coded device used to change the state of an access system. The output of switch 32 is connected to control module 18. As shown, switch 32 is active low, which means that the voltage potential of power source 20 is connected through switch 32 to control module 18 when switch 32 is not being activated. When switch 32 is activated, switch 32 connects ground potential to control module 18. When switch 32 output is ground potential, control module 18 detects that switch 32 has changed state. It this example, a single throw switch is used, however, a double throw switch may also be used.

Timer 22 is a device capable of timing the duration between events or a series of events. Timer 22 measures the duration that the switch signal is at a particular state. Timer 22 is represented in FIG. 2 as a separate device. However, one skilled in the art would recognize that it may be incorporated as an integral part of control module 18.

Solenoid 24 represents an electrically activated device used to mechanically open and close latch 16. Solenoid 24 may also be a motor or other electromechanical device.

Operator feedback device 26 may be a variety of devices including a dashboard light, an audible chime or a flag set within control module 18 that is read at a later time with diagnostic equipment.

Figure 3A:
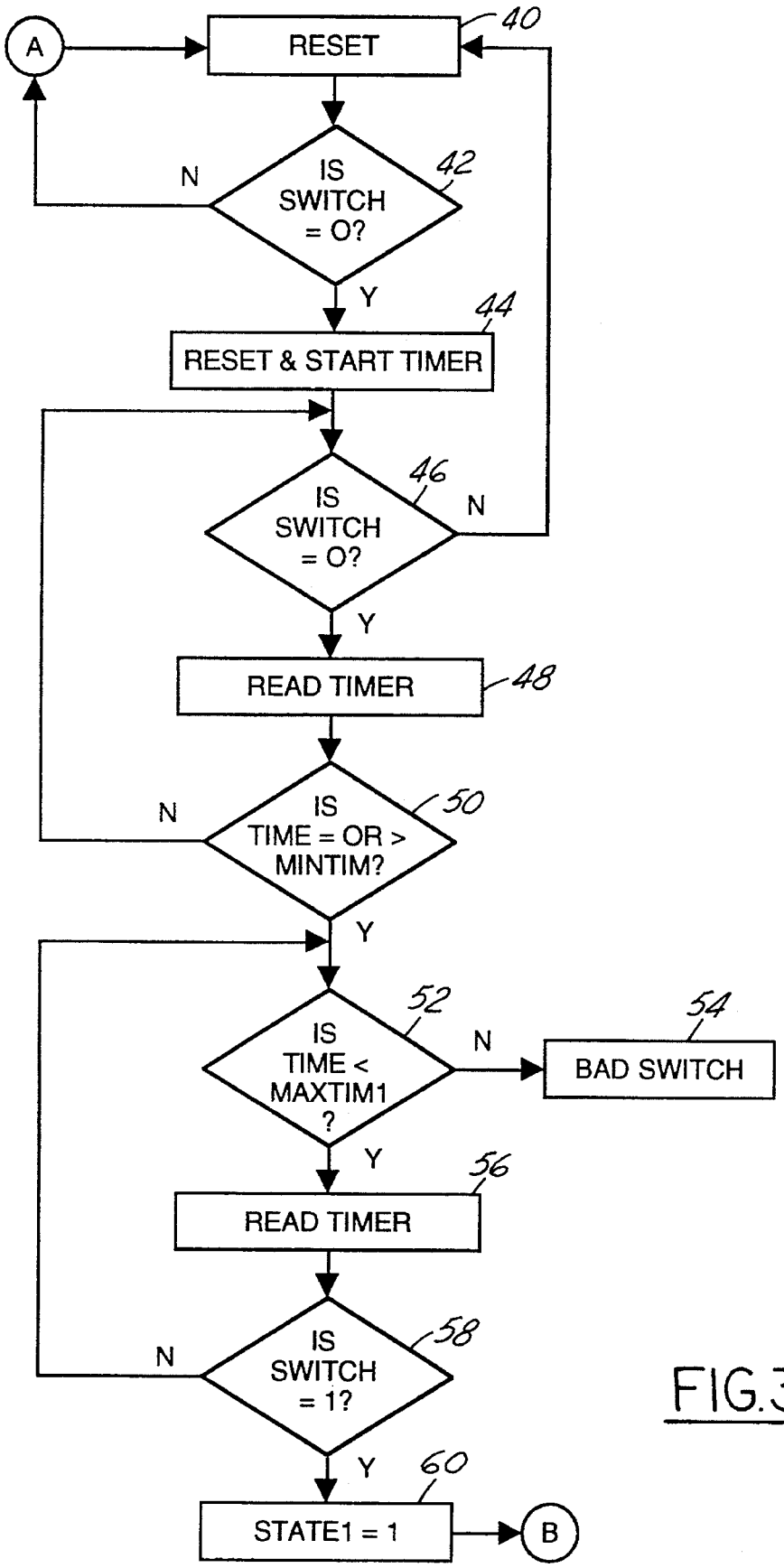
FIGS. 3A–3C together depict a flow chart of the operation of the preferred embodiment of the present invention.
Figure 3B:
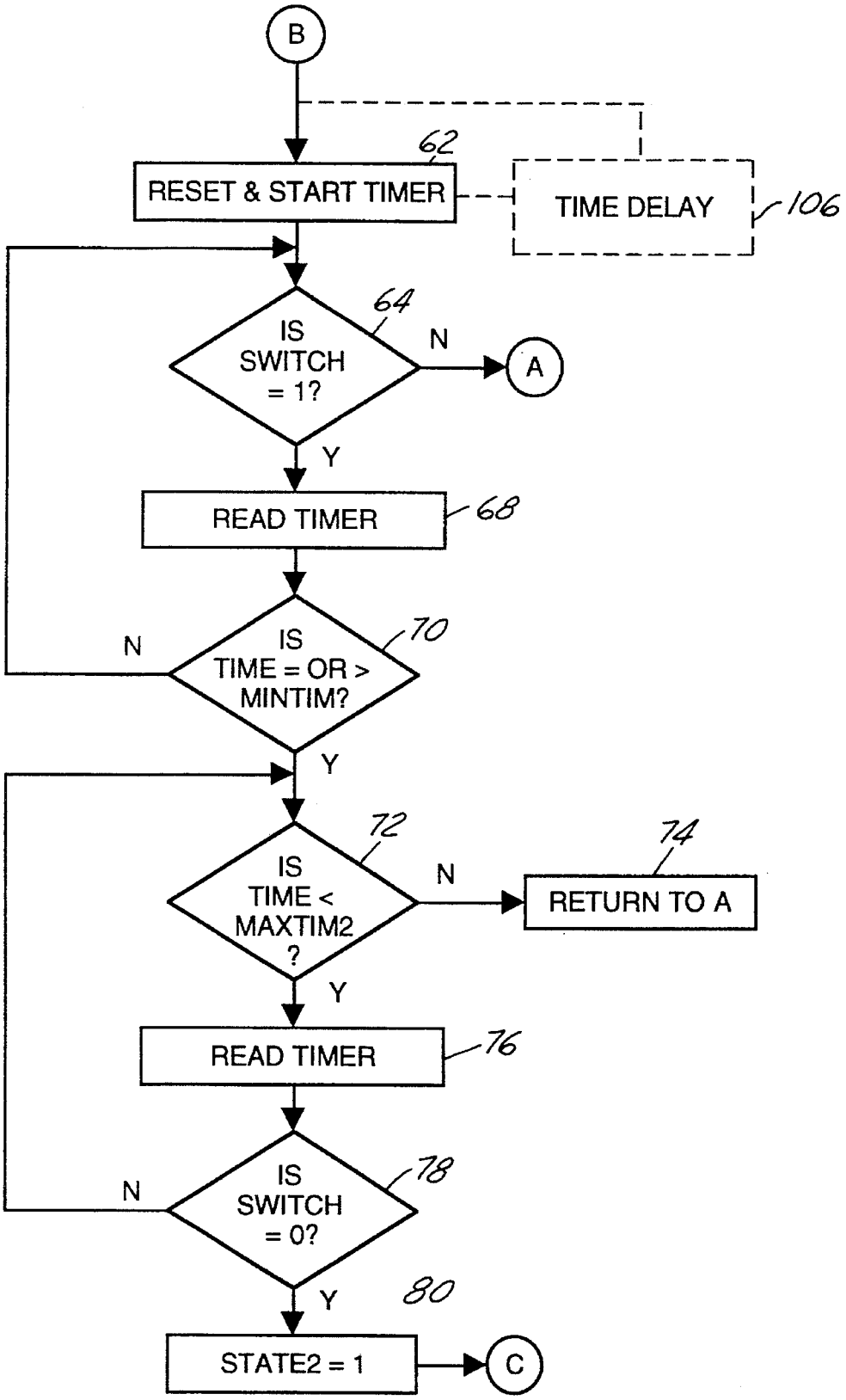
Figure 3C:
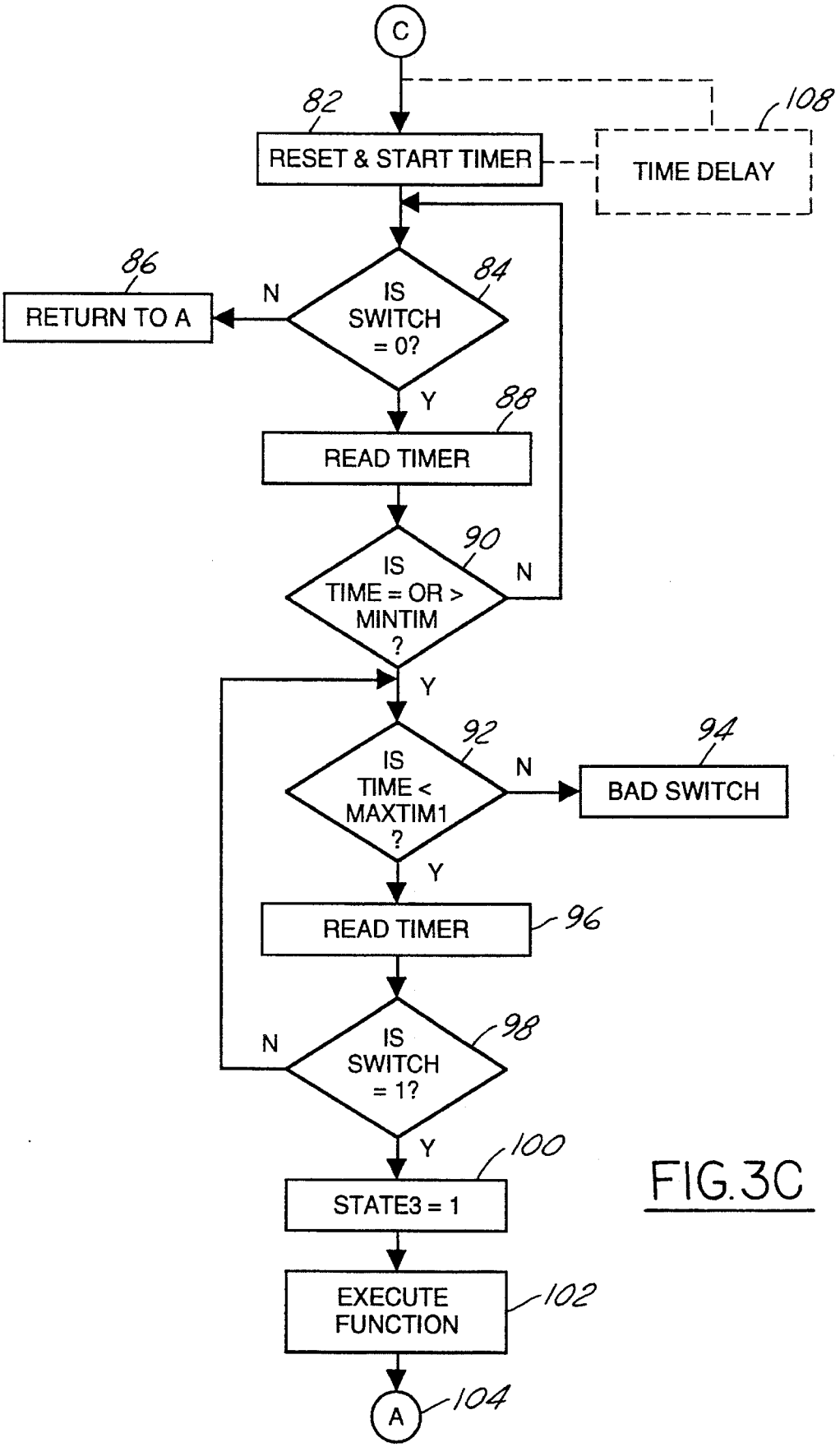

Referring now to FIGS. 3A–3C, the following description assumes an activated switch, (i.e., during key rotation) is at ground potential or logic "0." Logic "1" in this example corresponds to power supply voltage. One skilled in the art will recognize that activation with a high logic level would be equivalent.

Control module 18 has three internal states or flags: State1, State2, and State3 which in this case are "0" for off and "1" for on. The status of the states is set according to the conditions set forth below. The locking sequence starts in Step 40 with a reset in which State1, State2 and State3 are all set to "0." In Step 42, the output of the switch is checked to see whether the output is low. If the output is high (i.e., the switch is open or not activated), the system continuously executes Step 40 to monitor the switch state until switch is closed or activated. If in Step 42, the output of switch is low, timer 22 is reset. If a mechanical link is used, the latch is unlatched at about this point. In Step 46, the switch output is again checked. If the switch output is high, the system is set back to Step 40 and reset. If the output of switch is low, then the timer is read in Step 48. In Step 50, the timer value is compared to a minimum time (minTim), which is in this case is preferably about 100 milliseconds. MinTim preferably corresponds to the length greater than the time of a typical noise spike. Any signal having a duration less than minTim is considered noise; anything greater than minTim is considered a possible true signal. In Step 50, if the timer value is not greater than or equal to the minTim, the system returns to Step 46. If it is greater than the minTim, then Step 52 checks the timer to see whether the elapsed time is less than a maxTim1. MaxTim1 corresponds to the length of time the switch may be closed after which a fault in the switch is most probable. MaxTim1 in this case is 30 seconds. If the time is greater to or equal to maxTim1, then a bad switch is present and Step 54 is executed. Step 54 may provide an indication of operator feedback as to the presence of a bad switch. If in Step 52, the timer is less than maxTim1, then the timer is read in Step 56. In Step 58, the output of the switch is checked to see whether it has changed states, i.e., to see whether the state of the switch is logic level high. If the switch output is not high, Steps 52–58 are executed again. If the output of switch 58 is high, Step 60 is executed. Step 60 sets State1 in control module 18 to 1. Steps 52–60 monitors that the switch has maintained a logic level 0 for a predetermined amount of time.

In Step 62, the timer is reset. In Step 64, the state of switch is again checked to see whether it is high level or low level. In Step 64, if the switch is signal low a return is made to step 40 via point A. In this event, the switch has not been in high state long enough, so the system is reset. In Step 64, if the switch is still at logic level 1, the timer is read in Step 68. In Step 70, the time is compared to minTim to see whether logic level 1 has been maintained for at least a minimum amount of time, i.e., greater duration than a noise spike. If the high logic level has not been maintained for a minimum amount of time, the system is returned to Step 64. If logic level 1 has been maintained for a minimum amount of time, Step 72 is executed. Step 72 checks to see whether the timer is less than a maximum time maxTim2. If the switch signal has been the high logic level for greater than maxTim2, Step 74 is executed. In Step 74 the system will return to Step 40 because the two step unlock criteria has not been met. It should be noted if a mechanical link is used the door is unlocked at this stage. MaxTim2 is set at 5 seconds for this example. In Step 72, if time is less than maxTim2, the timer is read in Step 76. Step 78 is then executed to check whether a logic level low is now present at the output of the switch. If logic level low is not present at the output of the switch, Step 72–78 are executed again. If, in Step 78, the switch is equal to logic level low, Step 80 is executed, which sets State2 to "1". Processing continues at point C.

In Step 82, the timer is reset. In Step 84, the output of the switch is checked. If the output of the switch has changed to a logic level high, then step 86 is executed. In step 86, the system will return to Step 40 because the two step unlock criteria has not been met. It should be noted if a mechanical link is used the door is unlocked at this stage. The normal door-unlock function is executed in Step 86. Then, the flags are reset in Step 40. If the switch is still at low level logic, the timer is read in Step 88. In Step 90 the time elapsed is compared to minTim. If the logic state has not been at logic level low for at least a minimum amount of time, Step 84–90 are again executed. If during step 90, the time is equal to or greater than the minTim, then Step 92 is executed. This ensures that logic level low has been held for at least a minimum amount of time. In Step 92, the time is compared to maxTim1. If the time is not less than the maxTim1, Step 94 is executed indicating a bad switch similar to step 54. In Step 92, if the time is less than the maxTim1, then the timer is again read in Step 96. In Step 98, the output of the switch is at low logic level, then Step 92–98 are once again executed. If in Step 98, the switch has changed to high logic level, then Step 100 is executed to set State3 to logic level high in control module 18. Thereafter, Step 102 is executed, which executes a function, such as enabling all the lock solenoids to unlock all doors in the automobile. Step 104 returns the system to reset at the beginning of FIG. 3A.

Steps 106 and 108 are optional steps that may also be implemented. Step 106 and 108 add a time delay into the system to prevent control module 18 from activating on the switch transients. The time delay is a form of switch debounce and it must be long enough to prevent control module 18 from reading the output of switch 32 during the time of switching. Switch debounce may not be required if control module 18 samples the switch output at times greater than the typical debounce time. Other methods of switch debounce would be evident to one skilled in the art.

Figure 4:
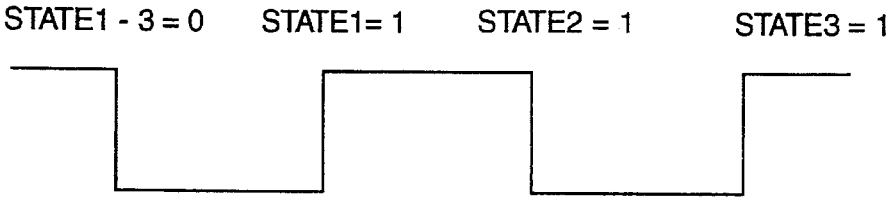
FIG. 4 is a timing diagram of the operation of the present invention.

Referring now to FIG. 4, the timing diagram of the operation of the locking system is shown. Initially, States 1–3 are equal to 0. The switch signal, at this point, is at a logic level high. State1 is set to logic 1 when logic level 0 has been present at the output of switch 32 for at least a minimum amount of time and less than a maximum amount of time. State2 is set to a 1 when high level logic is present at the output of switch 32 for at least a minimum duration and less than a maximum duration. State3 is set to 1 when the switch went low for a required duration in operation. When key 28 is inserted into lock cylinder 30, the operator desires the doors to unlock. Key 28 is rotated within lock cylinder 30 once to unlock the door in which the key is operating. When all the doors are desired to be opened, the key is again rotated within lock cylinder 30 within a predetermined amount of time. That will unlatch all the doors of the automobile. It should be understood by one skilled in the art that since a required duration is required to activate the lock system, noise spikes will not cause the lock system to activate erroneously since the switch signal must be at a predetermined amount of time at a particular state. A noise spike is less than the predetermined amount of time. Also, if moisture enters lock cylinder 30 and shorts the contacts of switch 32, lock cylinder control module will prevent erroneous unlocking of the vehicle since the signal from the lock will exceed a time limit at a particular state.

Many modifications of the present invention will be evident to those skilled in the art. All such modifications are within the scope of the present invention. One example of a modification would be the maximum time and the minimum amount of time the control module 18 requires the output of switch 32 to be in before changing states.

We claim:

1. A lock system for an automotive vehicle comprising:

an electrically controlled latch having a locked and unlocked position;

a switch generating a signal having a first state and a second state;

a timer:

a controller connected to said switch, said latch and said timer, said controller electrically controlling said latch to move to said unlocked position if said switch signal changes from said first state to said second state for at least a first predetermined time and less than a second predetermined time and then changes to and remains in said first state for at least a third predetermined time.

2. A lock system for an automotive vehicle as recited in claim 1 wherein said switch comprises a lock cylinder.

3. A lock system for an automotive vehicle as recited in claim 2 wherein said lock cylinder is key activated.

4. A lock system for an automotive vehicle as recited in claim 1 further comprising a feedback means connected to said controller for indicating a failure of said switch if said switch is in said second state greater than said second predetermined time.

5. A lock system for an automotive vehicle as recited in claim 1 wherein said feedback means is an indicator light.

6. A lock system for an automotive vehicle as recited in claim 1 wherein said feedback means is a diagnostic flag.

7. A lock system for an automotive vehicle as recited in claim 1 wherein said first predetermined time is longer than a duration of a noise spike.

8. A lock system for an automotive vehicle having at least two doors, comprising:

at least two electrically controlled latches each having a locked and unlocked position, each latch associated with one of said doors;

a switch generating a signal having a first state and a second state;

a timer;

a controller connected to said switch, said latches and said timer, positioning one of said latches in an unlocked position if said switch signal changes from said first state to said second state for at least a first predetermined time and less than a second predetermined time and then changes to and remains in said first state for at least a third predetermined time and less than a fourth predetermined time and positioning said remaining latches in said unlocked position if said switch changes from said first state to said second state for at least a fifth predetermined time and less than a sixth predetermined time and changes from said second state to said first state.

9. A lock system for an automotive vehicle as recited in claim 8 wherein said switch comprises a lock cylinder.

10. A lock system for an automotive vehicle as recited in claim 9 wherein said lock cylinder is key activated.

11. A lock system for an automotive vehicle as recited in claim 8 further comprising a feedback means connected to said controller for indication a failure of said switch if said switch is in said second state greater than said second predetermined time or said sixth predetermined time.

12. A lock system for an automotive vehicle as recited in claim 8 wherein said feedback means is an indicator light.

13. A lock system for an automotive vehicle as recited in claim 8 wherein said feedback means is a diagnostic flag.

14. A lock system for an automotive vehicle as recited in claim 8 wherein said first predetermined time is longer than a duration of a noise spike.

15. A method of operating a lock system of an automobile having a door with a latch and a switch having a first state and a second state, said method comprising the steps of:

changing the state of said switch from a first state to a second state for at least a first predetermined time and less than a second predetermined time;

changing the state of said switch from said second state to said first state for at least a third predetermined time and less than a fourth predetermined time;

unlatching said latch but not latching if the state of said switch when switching from said first state to said second state is less than said first predetermined time or greater said second predetermined time or when switching from said second state to said first state is less than said third predetermined time or greater than said fourth predetermined time.

16. A method of operating a lock system as recited in claim 15 further comprising the step of:

indicating a failure of said switch if said switch is in said second state greater than said second predetermined time.

17. A method of operating a lock system as recited in claim 15 wherein said automobile has at least two doors and a latch associated with each door further comprising the steps of:

changing the state of said switch from a first state to a second state for at least a fifth predetermined time and less than a sixth predetermined time;

changing the state of said switch from said second state to said first state:

unlatching each of said latches.

18. A method of operating a lock system as recited in claim 15 further comprising the step of:

indicating a failure of said switch if said switch is in said second state greater than said second predetermined time or said sixth predetermined time.

19. A lock system for an automotive vehicle having at least two doors, comprising:

at least two electrically controlled and mechanically controlled latches each having a locked and unlocked position, each latch associated with one of said doors;

a switch generating a signal having a first state and a second state;

a timer;

a controller connected to said switch, said latches and said timer, after one of said latches is mechanically unlatched, positioning each of said remaining latches in an unlocked position if said switch signal changes from said first state to said second state for at least a first predetermined time and less than a second predetermined time and then changes to and remains in said first state for at least a third predetermined time and less than a fourth predetermined time and changes from said first state to said second state for at least a fifth predetermined time and less than a sixth predetermined time and changes from said second state to said first state.

20. A method of operating a lock system of an automobile having doors each with a latch and a switch associated therewith, each switch having a first state and a second state, said method comprising the steps of:

mechanically unlatching one of said latches;

changing the state of said switch from a first state to a second state for at least a first predetermined time and less than a second predetermined time;

changing the state of said switch from said second state to said first state for at least a third predetermined time and less than a fourth predetermined time;

again changing the state of said switch from a first state to a second state for at least a fifth predetermined time and less than a sixth predetermined time;

changing the state of said switch to said first state;

electrically unlatching each of said latches which are not already unlatched;

but not latching each of said latches if the state of said switch when switching from said first state, to said second state is less than said first predetermined time or greater said second predetermined time or when switching from said second state to said first state is less than said third predetermined time or greater than said fourth predetermined time or when switching from said first state to said second state is less than said fifth predetermined time or greater said sixth predetermined time.

* * * * *